US010017004B2

(12) United States Patent
Kim

(10) Patent No.: US 10,017,004 B2
(45) Date of Patent: Jul. 10, 2018

(54) THERMOCHROMIC WRITING INSTRUMENT

(71) Applicant: Dong-A Pencil Co., Ltd., Seoul (KR)

(72) Inventor: Hak Jae Kim, Daejeon (KR)

(73) Assignee: DONG-A PENCIL CO., LTD., Seoul (KR)

( * ) Notice: Subject to any disclaimer, the term of this patent is extended or adjusted under 35 U.S.C. 154(b) by 0 days.

(21) Appl. No.: 15/461,282

(22) Filed: Mar. 16, 2017

(65) Prior Publication Data

US 2017/0274700 A1 Sep. 28, 2017

(30) Foreign Application Priority Data

Mar. 25, 2016 (KR) ..... 10-2016-0036086

(51) Int. Cl.
*B43K 24/03* (2006.01)
*B43K 29/02* (2006.01)

(52) U.S. Cl.
CPC ..... *B43K 24/03* (2013.01); *B43K 29/02* (2013.01)

(58) Field of Classification Search
CPC ..... B43K 24/03; B43K 29/02
See application file for complete search history.

(56) References Cited

U.S. PATENT DOCUMENTS 4,176,979 A * 12/1979 Saida ..... B43K 24/03 401/100
4,352,580 A * 10/1982 Ando ..... B43K 24/03 15/429

(Continued)

FOREIGN PATENT DOCUMENTS

DE 19717028 C1 8/1998
EP 0305872 A1 3/1989

(Continued)

OTHER PUBLICATIONS

Extended European Search Report from European Patent Application No. 17162332.5, dated Aug. 21, 2017, 9 pages.

*Primary Examiner* — Jennifer C Chiang
*Assistant Examiner* — Bradley Oliver
(74) *Attorney, Agent, or Firm* — McDermott, Will & Emery LLP

(57) ABSTRACT

The present invention relates to relates to a thermochromic writing instrument that may use thermochromic ink and erase a written content by generating heat with a frictional member provided thereat.

An exemplary embodiment of the present invention provides a thermochromic writing instrument including: a body configured to be provided with a knock mechanism that exposes a thermochromic writing part to the outside or accommodates the thermochromic writing part; a rib configured to be provided at an inner circumferential surface of the body to protrude in a central line direction of the body; a moving member configured to move along the inside of the body; a frictional member configured to be provided at one side of the moving member to protrude out of the body; a weight configured to be provided at the other side of the moving member to contact or to not contact the knock mechanism according to movement of the moving member; and a guide configured to be disposed between the outside of the moving member and the inside of the body to move along the inside of the body and to be spaced apart from an outer circumferential surface of the moving member by a predetermined interval.

5 Claims, 6 Drawing Sheets

(56) References Cited

U.S. PATENT DOCUMENTS

| | | | | |
|---|---|---|---|---|
| 4,377,349 | A * | 3/1983 | Kunii | B43K 24/03<br>24/11 R |
| 2011/0318084 | A1 * | 12/2011 | Zaidman | B43K 24/03<br>401/109 |

FOREIGN PATENT DOCUMENTS

| | | | |
|---|---|---|---|
| JP | 2011-037086 | A | 2/2011 |
| JP | 2012-021072 | A | 2/2012 |
| JP | 2015-020282 | A | 2/2015 |
| JP | 2015-057329 | A | 3/2015 |
| WO | WO-2014-083560 | A1 | 6/2014 |

* cited by examiner

THERMOCHROMIC WRITING INSTRUMENT

CROSS-REFERENCE TO RELATED APPLICATION

This application claims priority to and the benefit of Korean Patent Application No. 10-2016-0036086 filed in the Korean Intellectual Property Office on Mar. 25, 2016, the entire contents of which are incorporated herein by reference.

BACKGROUND OF THE INVENTION

(a) Field of the Invention

The present invention relates to a thermochromic writing instrument that may use thermochromic ink and erase a written content by generating heat with a frictional member provided thereat.

(b) Description of the Related Art

Generally, a thermochromic writing instrument uses a thermochromic ink, and when it is necessary to erase a content written therewith, the written content may be rubbed with an erasing member to generate heat, thereby erasing the written content.

Such a thermochromic writing instrument is disclosed in Japanese Patent Laid-Open Publication No. 2015-20282. Japanese Patent Laid-Open Publication No. 2015-20282 discloses a knock-type writing instrument provided with an erasing member. According to the disclosed knock-type writing instrument, a movable pin is coupled to a holder provided with the erasing member in a form of a ball joint, and when writing, the movable pin may contact a knock mechanism, and when the writing instrument is turned upside down as opposed to a writing state, the movable pin is maintained in a state protruding from a rear end of the writing implement, thus the erasing member may rub the written content to generate heat, thereby erasing the written content using thermochromic properties.

When the aforementioned thermochromic writing instrument is normally erected (a state in which writing is possible), the movable pin should contact the knock mechanism, and when it is turned upside down (a state in which the written content may be erased), the movable pin should contact a catching protrusion provided in a body to support the erasing member. However, when the writing instrument is normally erected or is turned upside down, as the movable pin freely moves, it may not properly contact the knock mechanism, or in a case that the erasing member protrudes from the body, when a pressure is applied to the erasing member, the erasing member is not maintained in a state of protruding from the body, thus it may again enter into the body.

PRIOR ART DOCUMENTS

Patent Documents (Patent Document 1) Japanese Patent Laid-Open Publication No. 2015-20282 (Published on Feb. 2, 2015)

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a thermochromic writing instrument in which, when the writing instrument is normally erected and used, a knock mechanism thereof may smoothly operate, and when the writing instrument is turned upside down such that a frictional member thereof is rubbed to generate heat to erase a written content, the frictional member may stably maintain a state of protruding out of a body thereof.

An exemplary embodiment of the present invention provides a thermochromic writing instrument including: a body configured to be provided with a knock mechanism that exposes a thermochromic writing part to the outside or accommodates the thermochromic writing part; a rib configured to be provided at an inner circumferential surface of the body to protrude in a central line direction of the body; a moving member configured to move along the inside of the body; a frictional member configured to be provided at one side of the moving member to protrude out of the body; a weight configured to be provided at the other side of the moving member to contact or to not contact the knock mechanism according to movement of the moving member; and a guide configured to be disposed between the outside of the moving member and the inside of the body to move along the inside of the body and to be spaced apart from an outer circumferential surface of the moving member by a predetermined interval.

The moving member and the guide may be formed to have a cylindrical shape, and an outer diameter of the moving member may be smaller than an inner diameter of the guide.

A length of the guide may be smaller than that of a part of the moving member accommodated in the body.

A thickness of the guide may be the same as that of the rib.

The guide may be formed to have a tapered cylindrical shape, and an inner diameter of the guide may increase toward the rib.

The weight may be accommodated at the inside of the rib, or may be drawn out therefrom together with one end portion of the moving member.

According to the embodiment of the present invention, when the body is erected so that the writing is possible, the guide moves toward the rib by its own weight, and the weight combined to one end of the moving member closely contacts the knock mechanism while the moving member is guided by the guide, while when the body is turned upside down to erase the written content, since the guide moves by its own weight such that the weight is caught by the catching protrusion of the rib, although a force is applied to the frictional member, the frictional member maintains a stably fixed state, thus it is possible to smoothly operate the knock mechanism, and it is possible to improve convenience and stability because of erasing the written thermochromic content by using the frictional heat generated by the rubbing of the frictional member.

DETAILED DESCRIPTION OF THE EMBODIMENTS

Figure 1:
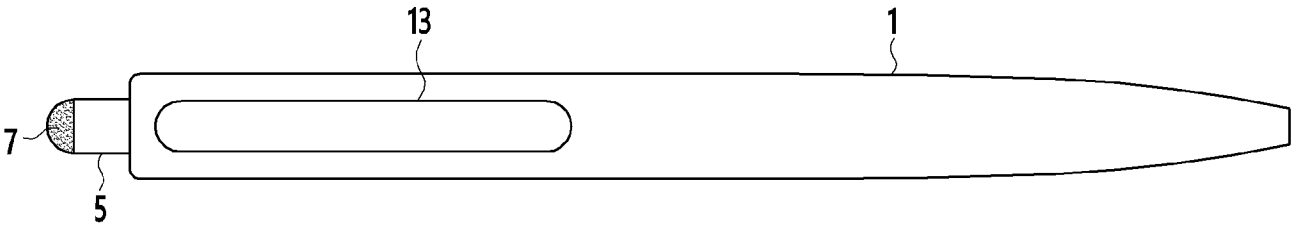
FIG. 1 illustrates an outline view of a thermochromic writing instrument according to a first exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

Figure 2:
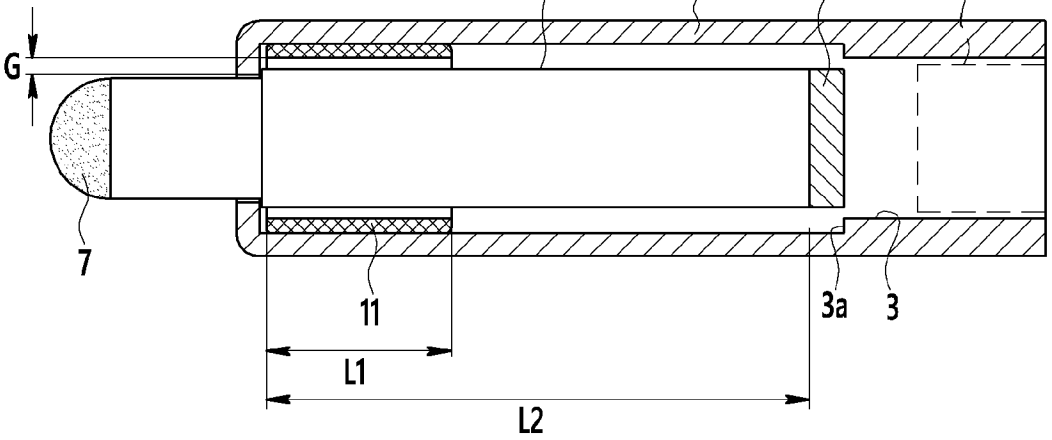
FIG. 2 illustrates a main cross-sectional view of thermochromic writing instrument of FIG. 1 taken in a length direction thereof.

FIG. 1 illustrates an outline view of a thermochromic writing instrument according to a first exemplary embodiment of the present invention, and FIG. 2 illustrates a main cross-sectional view of the thermochromic writing instrument of FIG. 1 taken in a length direction thereof.

A thermochromic writing instrument according to a first exemplary embodiment of the present invention includes a body 1, a rib 3, a moving member 5, a frictional member 7, a weight 9, and a guide 11.

The body 1 forms an outer shape of the thermochromic writing instrument, and a clip portion 13 may be provided at the outside thereof. A space is formed in the body 1, and a knock mechanism N and a thermochromic writing part (not shown) are provided in the space.

The knock mechanism N may be configured as a toggle switch type, and it serves to expose the thermochromic writing part from the body 1 to the outside or to accommodate it in the body 1. In the first exemplary embodiment of the present invention, since the knock mechanism N and the thermochromic writing part are specifically described in Japanese Patent Laid-Open Publication No. 2015-20282, a detailed description thereof will be omitted, thus only main features of the first exemplary embodiment of the present invention will be described with reference to the accompanying drawings.

It is preferable that the space forming the inside of the body 1 is formed to have a substantially cylindrical shape. The rib 3 is provided at an inner circumferential surface of a part of the body at which the knock mechanism N is installed.

The rib 3 may be formed to partially protrude from the inside of the body 1 in a central direction thereof, or to have a cylindrical shape with a smaller inner diameter than that of the body 1. The aforementioned knock mechanism N may be disposed at a central circular portion of the rib 3. A catching protrusion 3*a*, which restricts the moving member 5 and the weight 9 from moving along a length direction of the body 1, may be provided at the rib 3. The catching protrusion 3*a* may be disposed to be spaced apart from one end of the body 1 by a predetermined distance.

A portion of the moving member 5 that is accommodated in the body 1 may be substantially cylindrical, and one side of the moving member 5 may protrude in a length direction from the body 1. The moving member 5 may move in the length direction along the body 1, and it is caught by the catching protrusion provided at one end of the body 1 to not be completely drawn out from the body 1.

The frictional member 7 is provided at one end of the moving member 5. The frictional member 7 may be made of an elastic material such as a rubber material. The frictional member 7 generates frictional heat when rubbed on the content written in the thermochromic ink, thus it may erase the written content portion by discoloring it with the generated frictional heat. The frictional member 7 may be coupled to one end of the moving member 5 protruding from the body 1.

The weight 9 is coupled to the other end of the moving member 5. It is preferable that the weight 9 is disposed at an opposite end to that of the frictional member 7. That is, the weight 9 may be maintained in a state of being accommodated in the body 1. The weight 9 may be integrally formed with the moving member 5 to move together therewith while the moving member 5 moves along the length direction of the body 1.

The weight 9 may be formed to have the same shape as a part of the moving member 5 to which the weight 9 is coupled. That is, if the part of the moving member 5 to which the weight 9 is coupled is cylindrical, the weight 9 is cylindrical. The weight 9 may be inserted into the rib 3 together with a part of the moving member 5 to which the weight 9 is coupled. When the weight 9 is inserted into the rib 3, it may closely contact the knock mechanism N, and when the weight 9 is drawn out from the rib 3, it may be spaced apart from the knock mechanism N by a predetermined distance.

That is, as the weight 9 moves along the length direction of the body 1 together with the moving member 5, it may or may not contact the knock mechanism N.

The guide 11 may be disposed between the body 1 and the outside of the moving member 5. The guide 11 may move along the length direction of the body 1 by its own weight. It is preferable that the guide 11 is spaced apart from an outer circumferential surface of the moving member 5 by a predetermined gap G. The guide 11 may move relative to the moving member 5.

It is preferable that an inner diameter of the guide 11 is greater than an outer diameter of the moving member 5. In other words, the outer diameter of the moving member 5 is formed to be smaller than the inner diameter of the guide 11, thus they may move relative to each other along the length direction of the body 1.

It is preferable that a length L1 of the guide 11 is smaller than a length of the moving member 5. Herein, the length of the moving member 5 corresponds to the length L2 of the moving member 5 accommodated in the body 1 (refer to FIG. 2).

A thickness of the guide 11 may be the same as that of the rib 3.

The thickness of the rib 3 corresponds to a height of the catching protrusion 3*a* protruding from the inside of the body 1.

Figure 3:
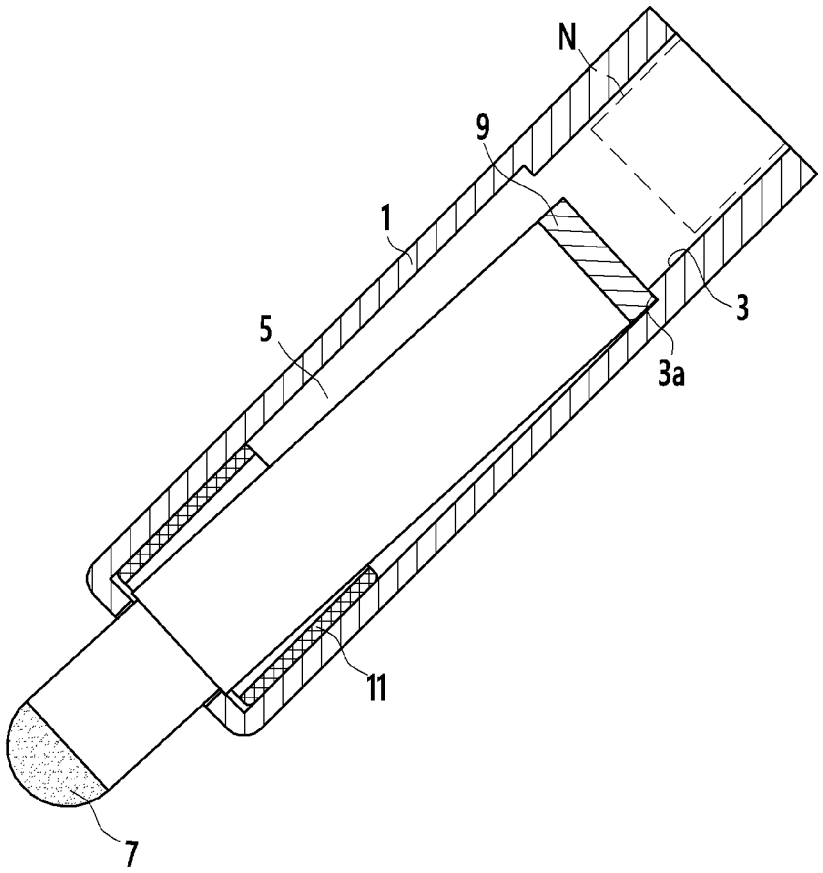
FIG. 3 illustrates a schematic view for explaining a state in which a frictional member according to a first exemplary embodiment of the present invention is used.
Figure 4:
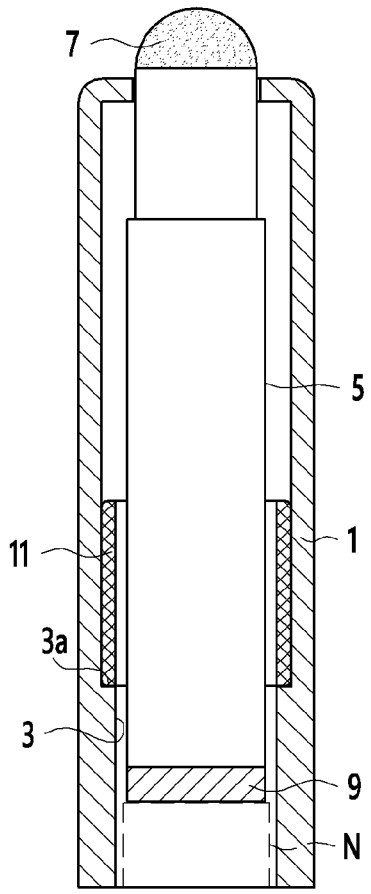
FIG. 4 illustrates a schematic view for explaining a state in which a knock mechanism according to a first exemplary embodiment of the present invention is used.

Operational processes of the thermochromic writing instrument according to the first exemplary embodiment of the present invention described above will be described in detail with reference to FIG. 3 and FIG. 4.

First, when the thermochromic writing instrument is in a writable state, that is, when the body 1 is erected, the guide 11 moves along the inside of the body 1 by its own weight to contact the catching protrusion 3*a* of the rib 3. In this case, while the weight 9 moves along the inside of the body 1 by its own weight, it is guided by the guide 11 to be inserted into the rib 3. Then, the moving member 5 coupled to the weight 9 moves together with the weight 9. In this case, the weight 9 contacts the knock mechanism N. When a user makes an action so that the frictional member 7 is pressed, the knock mechanism N operates, thus the thermochromic writing part is drawn out of the body 1 to be able to write with the thermochromic ink (refer to FIG. 4).

When the user wants to erase a written content, the user turns the body 1 upside down. That is, the user positions the body 1 so that the frictional member 7 is directed downward. Then, as the guide 11 and the moving member 5 move toward the frictional member 7, they are drawn out from the rib 3. Subsequently, the user tilts the body 1, and touches and rubs the frictional member 7 on the written content. In this case, as shown in FIG. 3, since the moving member 5 is tilted and the weight 9 closely contacts the catching protrusion 3*a* of the rib 3, the moving member 5 maintains a stable fixed state. When the user positions and rubs the frictional member 7 on the written content, frictional heat is generated, thus the content written in the thermochromic ink may be discolored and erased by the generated frictional heat.

As described above, according to the first exemplary embodiment of the present invention, by normally or reversely erecting the body 1, it is possible to stably write a necessary content or to stably erase the written content.

Figure 5:
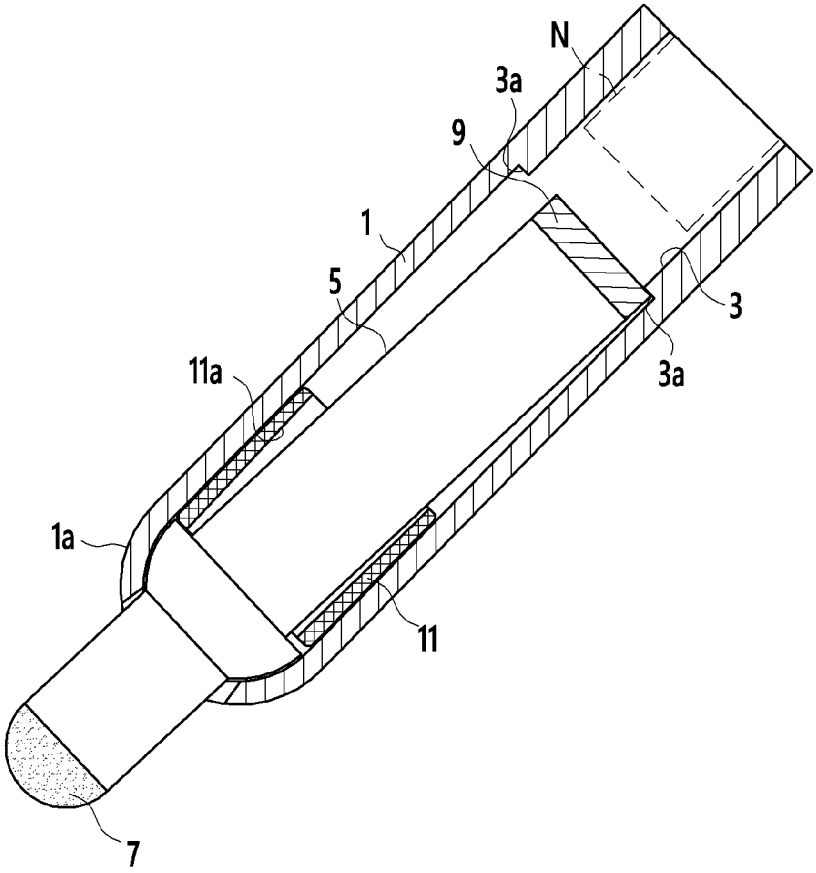
FIG. 5 and FIG. 6 illustrate cross-sectional views of a thermochromic writing instrument according to a second exemplary embodiment of the present invention.
Figure 6:
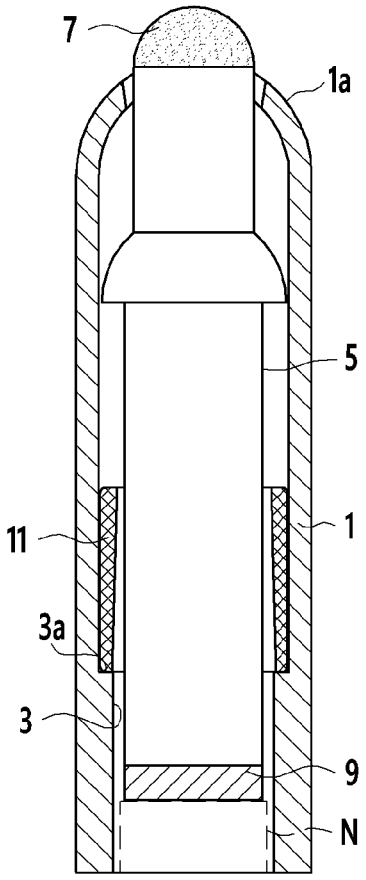

FIG. 5 and FIG. 6 illustrate cross-sectional views of main elements of a thermochromic writing instrument according to a second exemplary embodiment of the present invention. Compared with the aforementioned first exemplary embodiment, features of the second exemplary embodiment that are different from the first exemplary embodiment will be mainly described.

A guide 11 according to a second exemplary embodiment of the present invention includes a tapered portion 11*a* of which an inner circumferential surface is tapered.

It is preferable that an inner diameter of the tapered portion 11*a* of the guide 11 increases toward the rib 3.

According to the second exemplary embodiment of the present invention, when the body 1 is tilted, the moving member 5 is easily tilted together with the body 1, thus the weight 9 may more easily contact the catching protrusion 3*a* of the rib 3.

In addition, the body 1 of the second exemplary embodiment of the present invention may be provided with a rounded portion 1*a* of which the end portion of the body 1 is rounded. Accordingly, a shape of the moving member 5 may be changed to correspond to the rounded portion 1*a*. In this case, in a state in which the written content may be erased, the guide 11 may contact another catching protrusion provided at the moving member 5. According to the second exemplary embodiment of the present invention, by variously changing the outer shape of the body 1, it is possible to improve the appearance and to vary the structure of the moving member 5.

In the second exemplary embodiment of the present invention, when the written content is erased, since the guide 11 guides the moving member 5 so that the weight 9 more stably contacts the catching protrusion 3*a* of the rib 3, the thermochromic writing instrument may stably operate.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

1. body
1*a*. rounded portion
3. rib
3*a*. catching protrusion
5. moving member
7. frictional member
9. weight
11. guide
11*a*. tapered portion
13. clip portion

What is claimed is:

1. A thermochromic writing instrument comprising:
a body configured to be provided with a knock mechanism that exposes a thermochromic writing part to the outside or accommodates the thermochromic writing part;
a rib configured to be provided at an inner circumferential surface of the body to protrude in a central line direction of the body;
a moving member configured to move along the inside of the body;
a frictional member configured to be provided at one side of the moving member to protrude out of the body;
a weight configured to be provided at the other side of the moving member to contact or to not contact the knock mechanism according to movement of the moving member; and
a guide configured to be disposed between the outside of the moving member and the inside of the body to move along the inside of the body and to be spaced apart from an outer circumferential surface of the moving member by a predetermined interval,
wherein the guide is formed to have a tapered cylindrical shape, and an inner diameter of the guide increases toward the rib.

2. The thermochromic writing instrument of claim 1, wherein
the moving member and the guide are formed to have a cylindrical shape, and
an outer diameter of the moving member is smaller than the inner diameter of the guide.

3. The thermochromic writing instrument of claim 1, wherein
a length of the guide is smaller than that of a part of the moving member accommodated in the body.

4. The thermochromic writing instrument of claim 1, wherein
a thickness of the guide is the same as that of the rib.

5. The thermochromic writing instrument of claim 1, wherein
the weight is accommodated at the inside of the rib, or is drawn out therefrom together with one end portion of the moving member.

* * * * *